US006546109B1

(12) United States Patent
Gnecco et al.

(10) Patent No.: US 6,546,109 B1
(45) Date of Patent: Apr. 8, 2003

(54) ELECTROMAGNETICALLY SHIELDED HEARING AIDS

(76) Inventors: Louis Thomas Gnecco, 112-F Elden St., Herndon, VA (US) 22070; Paula Sharyn Gnecco, 112-F Elden St., Herndon, VA (US) 22070

( * ) Notice: Subject to any disclaimer, the term of this patent is extended or adjusted under 35 U.S.C. 154(b) by 0 days.

(21) Appl. No.: 09/476,131

(22) Filed: Jan. 3, 2000

(51) Int. Cl.[7] ..... H04R 25/00
(52) U.S. Cl. ..... 381/322; 381/328; 174/35 R
(58) Field of Search ..... 381/312, 322, 381/328, 330, FOR 127; 361/816, 818; 455/89, 90, 300; 174/35 R, 35 TS, 35 MS

(56) References Cited

U.S. PATENT DOCUMENTS 5,640,457 A * 6/1997 Gnecco et al. ..... 381/322
5,708,720 A * 1/1998 Meyer ..... 381/322
6,031,923 A * 2/2000 Gnecco et al. ..... 381/322

* cited by examiner

*Primary Examiner*—Huyen Le

(57) ABSTRACT

A Behind The Ear, In The Ear, All in The Ear, In The Canal, or Completely In The Canal hearing aid which is made resistant to electromagnetic interference produced by cellular telephones in the 800 MHz to 100 GHz frequency range. The resultant hearing aid will allow hearing impaired people to take advantage of cellular telephones and other recently-developed personal communication devices while also using their hearing aids.

1 Claim, 9 Drawing Sheets

ELECTROMAGNETICALLY SHIELDED HEARING AIDS

CROSS REFERENCES TO RELATED APPLICATIONS

This application is a continuation-in-part of pending application Ser. No. 08,835,350: "Electromagnetically Shielded Hearing Aid".

REFERENCE TO "MICROFICHE APPENDIX"

None

This invention was not made under any Federally sponsored research and development program.

BACKGROUND OF THE INVENTION

1. Field of the Invention

This invention relates to hearing aids, and specifically to Behind The Ear, In The Ear, In The Canal, or Completely In The Canal hearing aids which are being shielded to be resistant to electromagnetic interference produced by cellular telephones and other devices in the 800 MHz to 100 GHz frequency range.

2. Description of Related Art

The invention consists of the following: hearing aids which can be worn behind the ear, in the ear, or in the ear canal. These devices are widely known in the hearing aid industry as follows: Behind The Ear (BTE), In The Ear or All In The Ear (ITE), In The Canal (ITC), and Completely In The Canal (CIC).

This invention intends to shield these types of hearing aids from electromagnetic interference caused by cellular telephones in the 800 MHz–100 GHz frequency range by using an electrically conductive foil to shield the circuitry components. Furthermore, an electrically conductive gasket, paint or plastic could also be used to shield the circuitry components.

Also, a filtering circuit composed of inductors and capacitors is used to shield the circuitry components wherein ferrite beads or ferrite toroids are used as the inductors.

Also, a case consisting of a faceplate and a shell, the shell being made to fit in the ear, partially in the ear canal, or completely in the ear canal, and made wholly or partially of an electrically conductive material, the outside of which consists of a material such as an acrylic that produces no adverse affects when worn in the ear by most people.

The following devices are related to, but do not comprise any part of this invention: hearing aids worn elsewhere on the body other than in or behind the ear, known as "Body Aids", aids which intentionally use an electric field antenna or a plane wave antenna, hearing aids which couple sound waves through the bones of the head, known as "Bone Conduction" hearing aids, and also hearing aids which are built into eyeglass frames, and any devices which require surgery to install, such as Cochlear Implants.

DESCRIPTION OF PRIOR ART

FIG. 5 (Prior Art) Illustrates the elements which comprise a hearing aid. A Behind The Ear hearing aid is used for the illustration, but the same components are found in other hearing aids wherein the only difference could be the shape or size.

FIG. 5 (Prior Art) shows a hearing aid consists of an outer case 1, usually made of plastic such as Lucite (Poly Methyl Methacrylate), Non-Toxic Lucite, Poly Ethyl Methacrylate, Poly Vinyl Chloride, Silicone, or Polyethylene.

The case 1 houses and protects the internal circuitry components. The hearing aid has a battery door 3 which can be opened to replace the battery, an opening for a microphone 5, an opening for the speaker or receiver 6, and an opening for the volume control knob 7. The case 1 often has switches and controls, such as an optional telecoil pickup switch which couples the hearing aid electromagnetically to a telephone handset. The internal components 2 also consist of amplifiers and signal conditioning circuits as shown in the block diagram. These circuits contain non linear elements such as transistors. Some of the internal components are coupled by fine internal wires 10.

Besides all these openings as disclosed above, In The Ear, In The Canal, or Completely In The Canal hearing aids have a vent hole (not shown) to prevent the buildup of air pressure and moisture in the ear canal. This vent hole goes completely through the hearing aid. To build an effective hearing aid, one requires several openings due to current technology. Today's hearing aid users are adversely affected by radio signals that are produced by cellular telephones and other devices in the 800 MHz to 100 GHz frequency range. These signals are often pulse modulated at rates of 200 Hz to 300 Hz. Conventional hearing aids can unintentionally act as radio receivers, with their internal wires 10 acting as unintentional antennas, and their nonlinear elements unintentionally acting as detection and demodulating circuits. This causes the hearing aid to produce annoying or intolerable sounds, such as a 200 Hz to 300 Hz hum.

Shapiro (U.S. Pat. No. 2,327,320) teaches a body-hearing aid with a shield against electromagnetic interference which undoubtedly is only effective for low frequency sources of electromagnetic interference such as motors, hair dryers, and possibly fluorescent lights. It should be noted that this shield would not be effective against the current ultra-high frequency signals being experienced by today's hearing aid users. Ferrite beads and transistors were not available at this time and therefore, current circuitry components can not be shielded by the methods disclosed by Shapiro.

SUMMARY OF THE INVENTION

The invention consists of the following hearing aids which can be worn behind the ear, in the ear, or in the ear canal, these devices are widely known in the hearing aid industry as follows: Behind The Ear (BTE), In The Ear or All In The Ear (ITE), In The Canal (ITC), and Completely In The Canal (CIC). In this document, the phrase "hearing aid worn in the ear" refers to ITE, ITC, and CIC hearing aids.

This invention intends to shield these types of hearing aids from electromagnetic interference caused by cellular telephones in the 800 MHz–100 GHz frequency range by using an electrically conductive foil to shield the circuitry components. Furthermore, an electrically conductive gasket, paint or plastic could also be used to shield the circuitry components.

Also, a filtering circuit composed of inductors and capacitors is used to shield the circuitry components wherein ferrite beads or ferrite toroids are used as the inductors.

Also, a hearing aid worn in the ear consisting of a face plate and a shell, each made wholly or partly of a conductive material, and made in such a way that none of the conductive material comes in contact with the ear when the hearing aid is worn.

DETAILED DESCRIPTION

Figure 7:
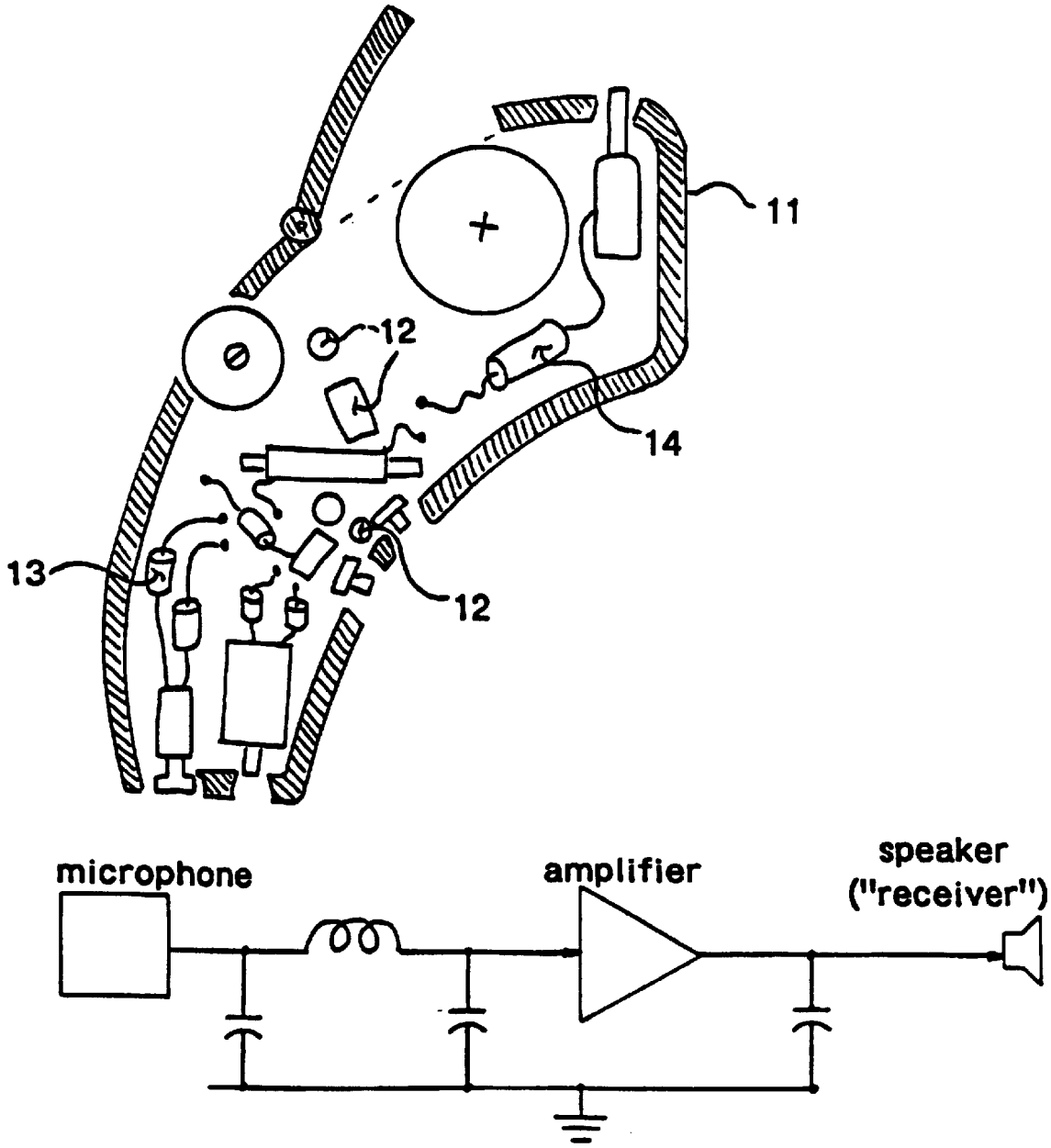
FIG. 7 describes the invention.
Figure 8:
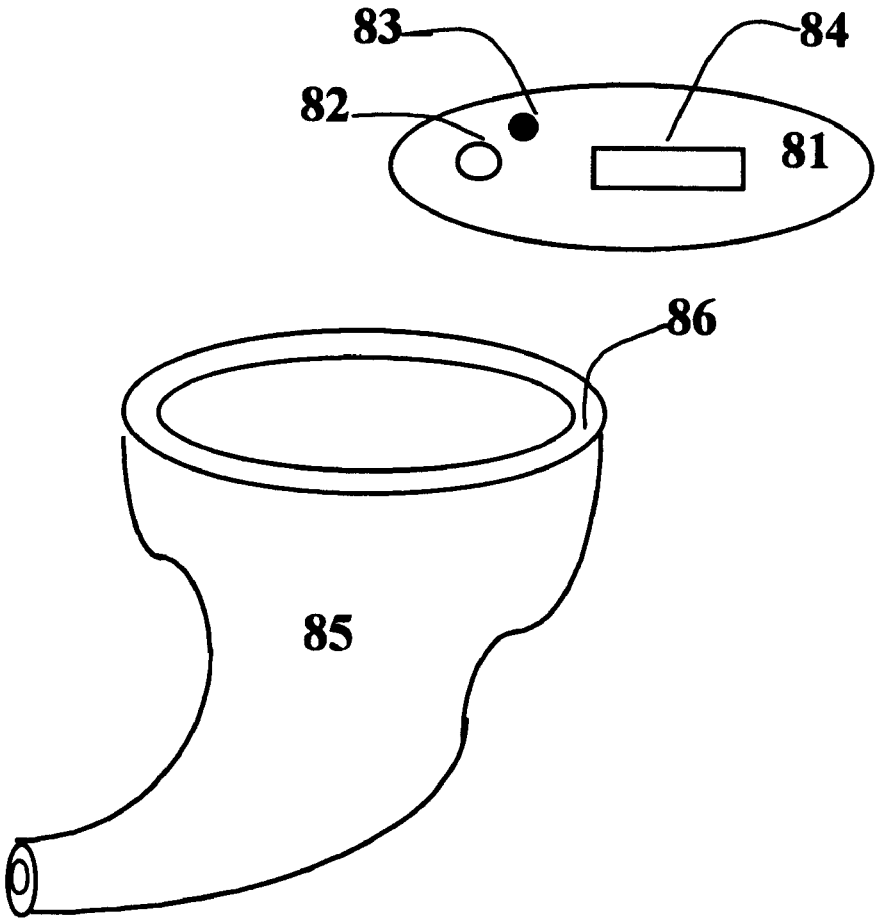
FIG. 8 shows the details of an electromagnetically shielded In The Ear hearing aid consisting of a face plate 81 and a shell 85.
Figure 9:
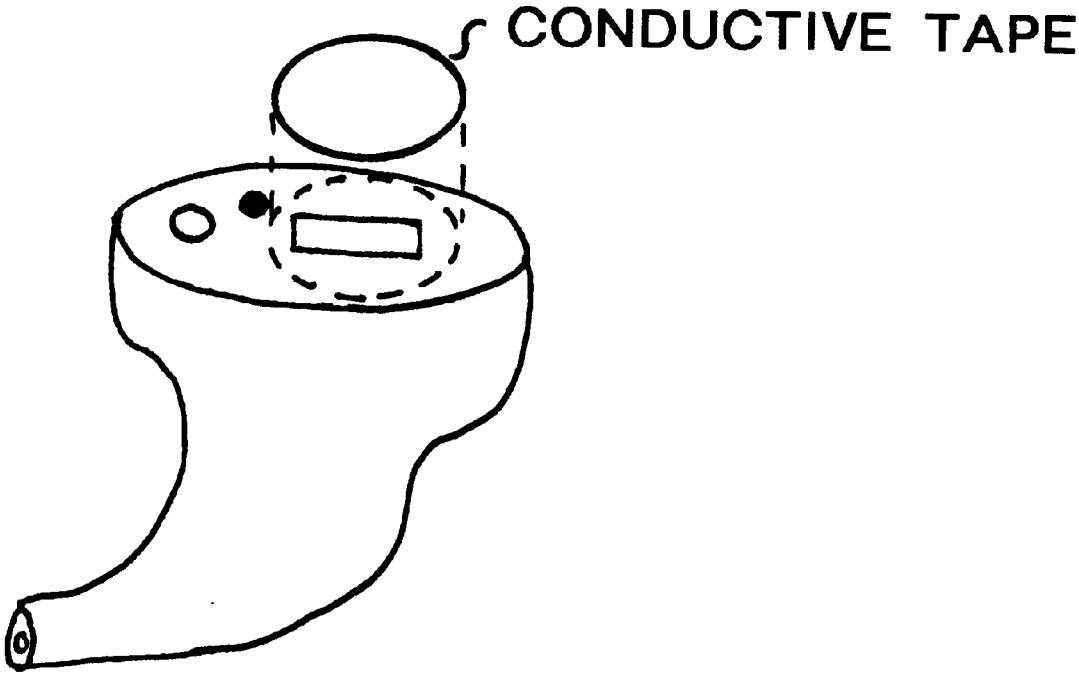
FIG. 9 shows the face plate 91 and the shell 95 after final assembly.

The invention, shown in FIGS. 7, 8 and 9 consists of the following elements: an outer case 11, which holds and protects the internal components 12 and is shielded by one or more of the following:

- 11*a*: Painting the case with a conductive coating, usually a paint which is filled with silver, nickel, or copper, such as the following products made by Chomerics, Inc. of Woburn Massachusetts: "Cho-Shield 596" or "Cho-Flex 601."
- 11*b*: Lining the case with an electrically conductive material such as conductive foil, usually copper or aluminum foil, such as "Cho-foil" produced by Chomerics, Inc.
- 11*c*. Making the case out of a conductive material, such as a plastic which has been impregnated with metal or carbon.
- 11*d*. Using conductive gaskets such as "CHO-seal 1215" made by Chomerics, Inc.

The outer case 11 houses the internal components 12 which must sometimes be shielded in addition to the case. The techniques used to shield the internal components 12 are those described in 11*a*, 11*b*, 11*c*, and 11*d* above.

Figure 1:
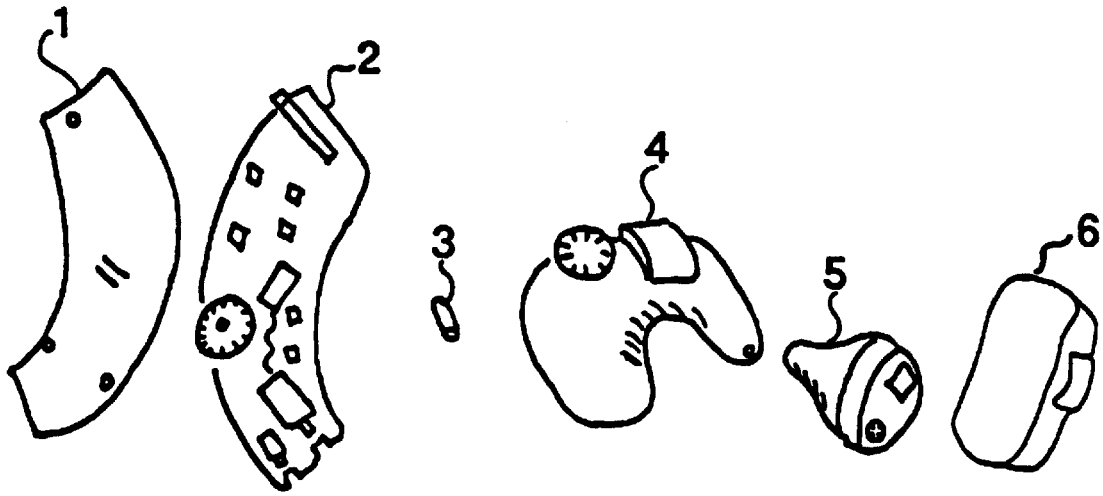
FIG. 1 (Prior Art)
FIG. 1 (Prior Art) shows a Behind The Ear hearing aid 1 and 2, an In The Ear hearing aid 4, In The Canal hearing aids 5 & 6 and a miniature ferrite bead 3 which can be used in this invention. The Completely In The Canal hearing aid is not shown.
Figure 2:
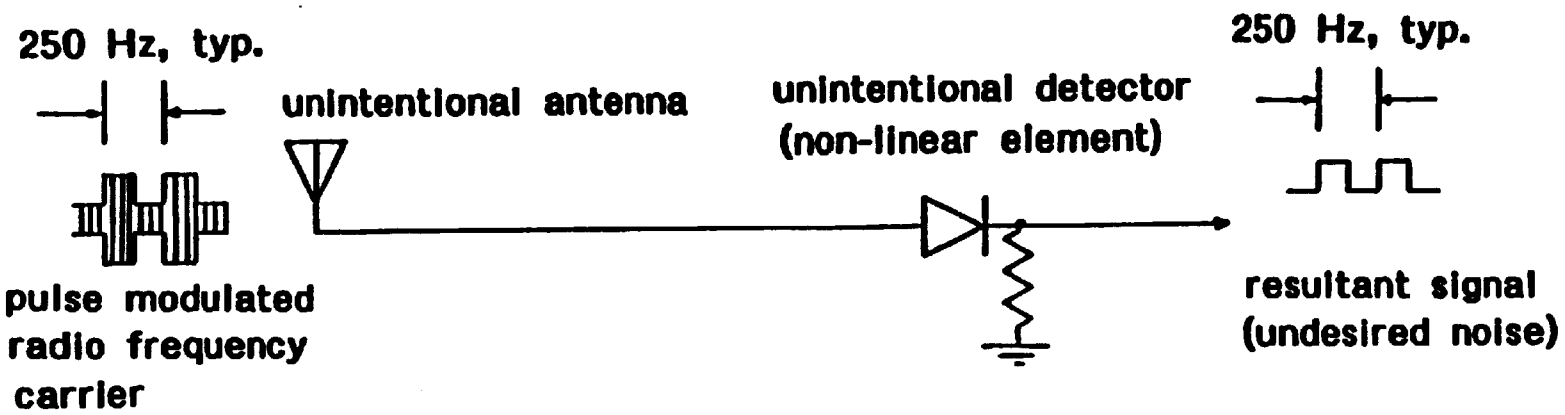
FIG. 2 shows how electromagnetic interference is transmitted by a cellular telephone, is received by an internal wire of the hearing aid which acts as an unintentional antenna, is detected and demodulated by a nonlinear element of the hearing aid (for example, a transistor), and results in a loud, audible signal which is annoying or intolerable to the hearing aid wearer.
Figure 3:
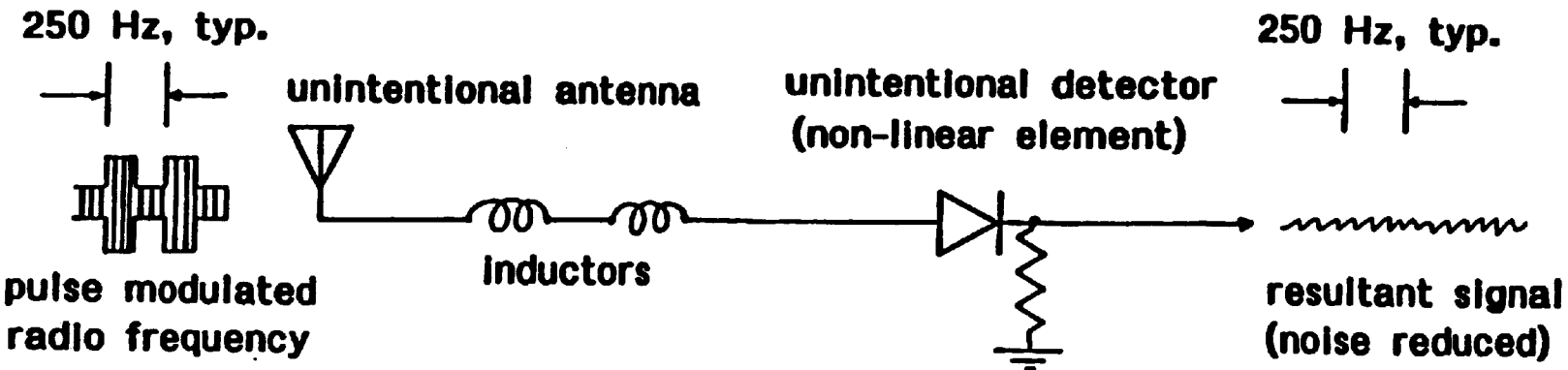
FIG. 3 Shows how the electromagnetic interference can be reduced or eliminated by adding one or more inductors in series with the internal wire which acts as an unintentional antenna. Ferrite beads can also be used in place of the inductors shown.
Figure 4:
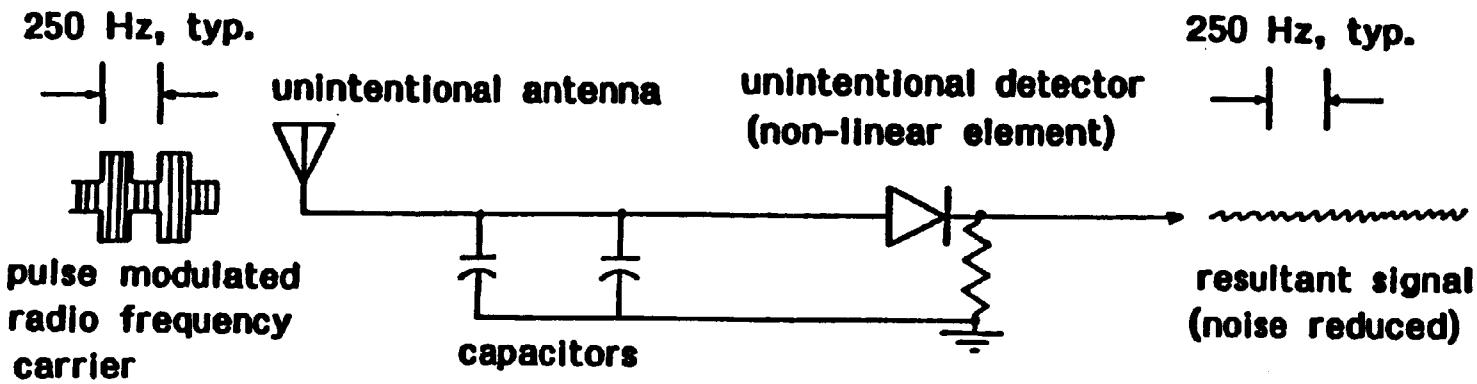
FIG. 4 shows how the electromagnetic interference can be reduced or eliminated by adding one or more capacitors in parallel with the internal wire which acts as an unintentional antenna.
Figure 5:
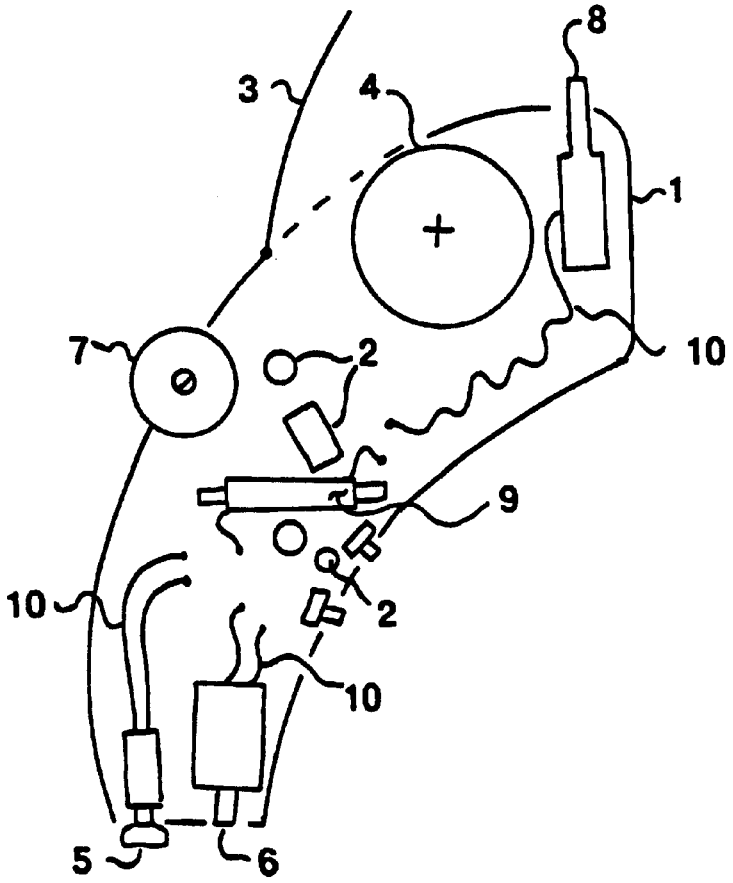
FIG. 5 (Prior Art)
FIG. 5. (Prior Art) mechanically and schematically illustrates the elements which comprise a hearing aid. A Behind The Ear hearing aid is used for the illustration, but the same elements apply to In The Ear, In The Canal, and Completely In The Canal hearing aids, the only difference being one of size and shape.
Figure 5:
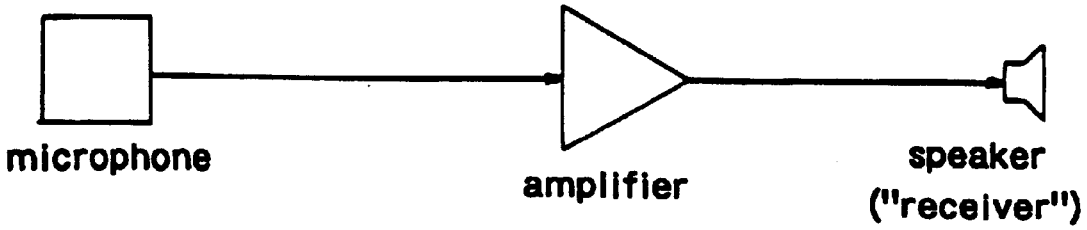
FIG. 5 (Prior Art)

The internal components 12 of the hearing aid must also be sometimes modified so that the 800 MHz–100 GHz radio signals produced by cellular telephones and other devices cannot pass effectively from one component to another. This is done in such a way that the normal functions of the hearing aid are not adversely affected. Some or all of the following techniques are employed:

- 12*a*: The addition of one or more inductors 13 in series. FIG. 2 depicts a pulse modulated radio signal such as those produced by some cellular telephones. This signal is unintentionally picked up by an internal wire, acting as an unintentional antenna. The signal is then demodulated and detected by one of the nonlinear elements of the hearing aid, such as the audio amplifier. As shown in FIG. 3, by adding one or more inductors in series with the unintentional antenna, the incoming radio signal is blocked by the high impedance of the inductors. The inductors present a low impedance to the intended audio signals, which pass through intact.
- 12*b*: The Addition of Ferrite beads 14: Ferrite beads, such as model #2673008501 made by Fair-Rite Inc. of Wallkill, N.Y. and depicted as item #3 in FIG. 1, when slipped over an internal wire effectively add an inductor in series as described in 12*a* above. Other shapes of the Ferrite material, such as toroids, rods, and custom molded shapes may be used.
- 12*c*: The addition of one or more capacitors in parallel: As shown in FIG. 4, the addition of one or more capacitors in parallel with the unintentional antenna has the same de-coupling effect as the addition of inductors in series. In this case, the capacitors present a very low impedance to the radio signal, shorting it to ground.

The capacitors present a high impedance to the audio signals, which pass through intact.

Figure 6:
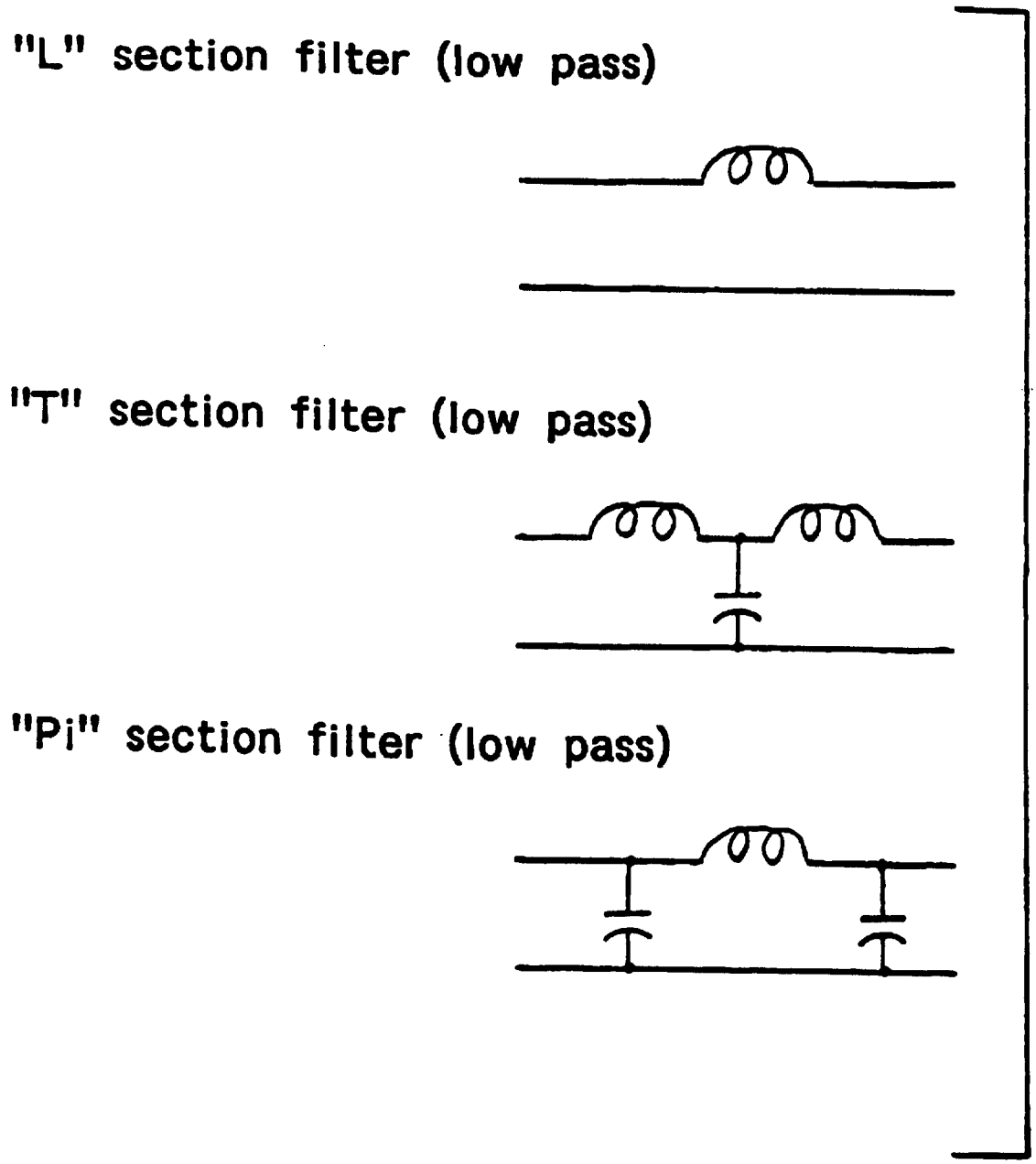
FIG. 6 (Prior Art)
FIG. 6 (Prior Art) Illustrates various ways in which inductors and capacitors can be arranged to form low-pass filters. Ferrite beads can be used in place of the inductors shown.

- 12*d*: Filtering: This consists of adding combinations of inductors (including ferrites) and capacitors as described in FIG. 6.
- 22: As shown in FIG. 8, an electromagnetically shielded hearing aid worn in the ear, that is an ITE, ITC or CIC hearing aid, consisting of a face plate 81 which may contain one or more controls 82, a microphone opening 83, and a battery door 84; and a shell 85, all made wholly or partially of an electrically conductive material, the shell 85 being molded to fit in the ear, or partially in the ear canal, or completely in the ear canal, and the outside of which is made of or covered by a material such as acrylic, which produces no adverse effects when worn in the ear by most people.

The face plate 81 is also made wholly or partially of an electrically conductive material, or covered by a conductive material, and its perimeter is cut so as to be congruent with the perimeter 86 of the opening of the shell, and to fit over it forming the case of the hearing aid as shown in FIG. 9.

The face plate 81 and the shell 85 are bonded mechanically and their conductive surfaces are bonded electrically. This can be done by using an electrically conductive adhesive, or any combination of conductive and non-conductive adhesives and one or more conductive gaskets. To prevent allergic reactions or other adverse effects, the electrical bonding is done in such a way that neither the conductive adhesive nor the conductive gasket will come in contact with the ear when the hearing aid is properly worn. One way to accomplish this is to cover the inside of the shell with conductive paint. This paint will also cover the perimeter 86 of the shell's opening. A conductive adhesive is applied to this perimeter, and the conductive part of the face plate is attached on top of this conductive perimeter. When the adhesive hardens, the conductive perimeter is buffed to a smooth finish.

If any conductive material remains accessible to the ear, it will be covered by a coating of a material such as acrylic, which produces no adverse effects when worn in the ear by most people. The face plate, most of which does not come in contact with the ear, can be made entirely of a conductive material or also coated with a material which produces no adverse effects when worn in the ear by most people.

Because the door of battery compartment can be a major opening through which radio signals can leak in, the door must be made partially or completely of a conductive material, and designed in such a way as to provide an electrical bond with the face plate. One way to do this is to design the door to be a threaded cap, like the top of a thermos bottle. Another way is to design the door to completely cover the opening, like the lid of a toilet seat, and using a conductive gasket to provide an effective electromagnetic shield.

Yet another way is to use a standard hearing aid battery door, and to cover it with a disposable strip of conductive tape which uses a conductive adhesive. For cosmetic reasons, the surface of this conductive tape can be dyed or painted to match the color of the hearing aid.

Hearing aids range from simple audio amplifiers to complex devices employing digital signal processing techniques. Each design presents a slightly different problem and some or all of the above protection techniques will be used. Because of the many openings that a hearing aid must have, it is impossible to shield its outer case 11 completely. The high field strengths and Ultra-High Frequencies produced by cellular telephones may require a combination of the above techniques.

The preferred embodiments are described in claims 1 and 4.

The resultant hearing aid will be unaffected by the radio signals produced by cellular telephones, allowing hearing impaired people to take advantage of cellular telephones and other personal communication devices while wearing their hearing aids.

What is claimed is:

1. An In The Ear, All in The Ear, In The Canal or Completely In The Canal hearing aid comprising: a case, internal components, a battery door, a battery, a microphone, a speaker a volume control, a telephone coil activation switch, a telephone coil, and internal wires;

the internal wires are made resistant to electromagnetic interference produced by cellular telephones in the 800 MHz to 100 GHz frequency range by lining the case with an electrically conductive material;

one or more inductors or ferrite devices are put in series with some of the internal wires or components;

one or more capacitors are put in parallel with some of the internal wires or components;

the internal components arc shielded from electromagnetic interference with electrically conductive foil, and conductive gaskets;

the case of the hearing aid further comprising a face plate and shell, said face plate and shell being made of or covered by an electrically conductive material, said face plate and shell being bonded together both electrically and mechanically in such a way that none of the conductive material comes in contact with the ear when the hearing aid is worn, and said face plate having said battery door made entirely or partially of conductive material, and said battery door being covered by a disposable strip of conductive tape, and said conductive tape having a conductive adhesive.

* * * * *